US007537557B2

(12) United States Patent
Holler

(10) Patent No.: US 7,537,557 B2
(45) Date of Patent: May 26, 2009

(54) FOLDER FEEDER

(75) Inventor: Bernd Holler, Zofingen (CH)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 11/783,491

(22) Filed: Apr. 10, 2007

(65) Prior Publication Data

US 2007/0254793 A1 Nov. 1, 2007

(30) Foreign Application Priority Data

Apr. 10, 2006 (EP) ..... 06405154

(51) Int. Cl.
*B31B 1/25* (2006.01)

(52) U.S. Cl. ..... 493/403; 493/396; 493/400; 493/401; 493/402; 493/60; 493/63; 493/64; 493/72; 493/241; 493/243

(58) Field of Classification Search ..... 493/59–64, 493/66–69, 71–72, 396–403, 240–241, 254
See application file for complete search history.

(56) References Cited

U.S. PATENT DOCUMENTS 3,438,622 A * 4/1969 Laschewski ..... 270/45
3,570,841 A * 3/1971 Rettig ..... 493/433
4,141,544 A * 2/1979 Birkenmayer ..... 493/355
4,221,373 A 9/1980 Mueller Hans
4,269,097 A * 5/1981 Linn ..... 83/482
4,792,325 A * 12/1988 Schmidtke ..... 493/334
4,881,935 A * 11/1989 Slobodkin ..... 493/355
5,031,889 A * 7/1991 Raker et al. ..... 270/45
5,094,660 A * 3/1992 Okuzawa ..... 493/320
5,529,563 A * 6/1996 Veith et al. ..... 493/395
7,201,089 B2 * 4/2007 Richter ..... 83/13

FOREIGN PATENT DOCUMENTS

EP 1 247 775 A 10/2002
GB 2 270 306 A 3/1994

OTHER PUBLICATIONS

European Search Report, issued Sep. 15, 2006, in EP06405154, and English translation.

* cited by examiner

*Primary Examiner*—Christopher Harmon
(74) *Attorney, Agent, or Firm*—Venable LLP; Robert Kinberg; Steven J. Schwarz

(57) ABSTRACT

A folder is adapted to fold sheets. A drum having a circumferential surface is adapted to withdraw sheets from a stack or from an overlapping flow and feed the sheets to the folder. A creasing apparatus is operatively arranged with the drum and includes: a first creasing wheel which cooperates with the drum to crease the withdrawn sheets that are fed to the folder, and a tracing wheel positioned at least axis parallel with the first creasing wheel and running on the circumferential surface of the drum to maintain a constant distance between the first creasing wheel and the circumferential surface of the drum.

13 Claims, 3 Drawing Sheets

FOLDER FEEDER

CROSS-REFERENCE TO RELATED PATENT APPLICATION

This application claims the priority of European Patent Application No. EP 06405154, filed on Apr. 10, 2006, the subject matter of which is incorporated herein by reference in its entirety.

BACKGROUND

The present invention relates to a folder feeder provided with a drum and used, for example, for withdrawing sheets and in particular printed sheets from a stack to feed the withdrawn sheets to a folder. The folder feeder comprises a first creasing wheel and a second creasing wheel that is arranged on the drum, which operates jointly with the first creasing wheel to crease the withdrawn sheets.

A folder feeder of this type is disclosed, for example, in European patent document EP-A-1 247 775 the disclosure of which is incorporated herein by reference. Printed sheets are pulled individually from a stack with a suction device and grippers and are folded on a folding sword during the continuous operation. The folded sheets are then deposited on a gathering chain where they are picked up by pushers. To obtain a sharp and if possible complete and closed fold, the pulled-off sheets are creased prior to the folding operation. The creased sheets are folded during the continuous operation on a folding sword, along the groove formed by the creasing. The quality of the fold depends on the quality of the creased groove. A creased groove that is not uniformly deep or is interrupted can result in a fold that is not sharp, is not complete, or is not closed. The folded sheets are subsequently used for producing print products such as brochures, magazines, catalogues, or books, meaning that in the final analysis, the quality of these print products also depends on the sheet fold quality.

SUMMARY OF THE INVENTION

It is therefore an object of the present invention to provide a folder feeder which allows producing a higher-quality fold while still ensuring a high output and operational safety.

The above object and other objects are accomplished according to the invention, which in one embodiment comprises a folder feeder, comprising: a folder adapted to fold sheets; a drum having a circumferential surface and adapted to withdraw sheets from a stack or from an overlapping flow and feeding the sheets to the folder; and a creasing apparatus operatively arranged with the drum and including: a first creasing wheel which cooperates with the drum to crease the withdrawn sheets that are fed to the folder, and a tracing wheel positioned at least axis parallel with the first creasing wheel and running on the circumferential surface of the drum to maintain a constant distance between the first creasing wheel and the circumferential surface of the drum.

The first creasing wheel is positioned on a tracing wheel, which moves on the second creasing wheel and is pressed with a spring force against a running surface of the second creasing wheel, thereby maintaining a uniform distance between the first creasing wheel and the circumferential surface of the second creasing wheel. A creasing wheel is understood to be a wheel used for creasing sheets.

The tracing wheel effectively balances out any untrue running of the second creasing wheel, which can be caused in particular by a high output by an unbalancing force, an untrue shape, or an eccentric movement of the drum. The first creasing wheel extends with its creasing edge to a uniform depth in the groove of the second creasing wheel, thereby ensuring that the formed crease has a uniform depth. The shaft of the first creasing wheel is thus at a constant distance to the circumferential surface of the second creasing wheel. Since the first creasing wheel is continuously pressed against the second creasing wheel, any untrue running or eccentricity of the second creasing wheel is balanced out immediately. As a result, it is possible to crease and fold sheets for which the weight varies considerably, for example ranging from 70 $g/m^2$ to 260 $g/m^2$, wherein the groove depth can be 0.02 mm. As a result of the aforementioned balancing operation, the production tolerance requirements and thus the production costs for the folder feeder can be lowered.

According to one embodiment of the invention, the first creasing wheel is positioned so as to be adjustable on the tracing wheel. An eccentric cam may be used to position the first creasing wheel on the tracing wheel, thereby making it easy to adjust the spacing between the first creasing wheel and the circumferential surface of the second creasing wheel and thus the depth of the groove.

According to another embodiment of the invention, the first creasing wheel and the tracing wheel form an integral unit that is positioned via an arm on a rod, wherein the rod extends parallel and at a distance to the shaft of the second creasing wheel and/or the drum. As a result, the first creasing wheel and the tracing wheel are positioned substantially stable and operationally safe.

According to another embodiment of the invention, an adjustment device may be used for adjusting the contact pressure of the first creasing wheel, wherein the use of a Bowden wire that acts upon the aforementioned extension arm permits an easy and precise adjustment.

The sheets may be conveyed substantially vertically during the creasing operation, wherein the sheets are picked up with a gripper drum and are guided between belts.

Additional advantageous features follow from the following description, as well as the drawings.

BRIEF DESCRIPTION OF THE DRAWINGS

These and other features and advantages of the invention will be further understood from the following detailed description with reference to the accompanying drawings in which.

DETAILED DESCRIPTION

Figure 1:
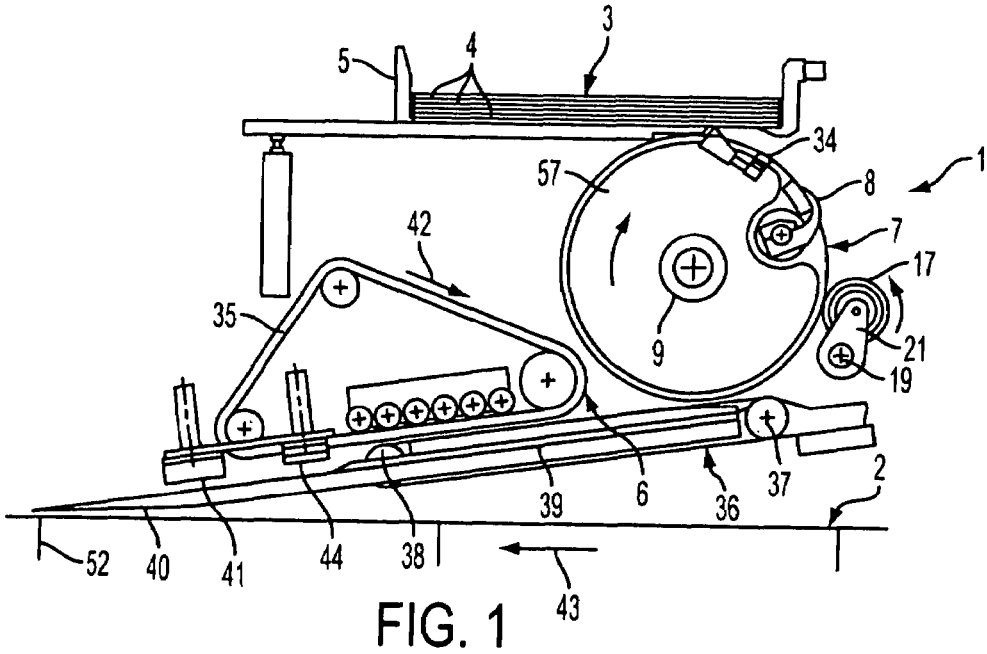
FIG. 1 A schematic view of a folder feeder according to an embodiment of the invention.

The folder feeder 1 shown in FIG. 1 is provided with a drum 7, which is driven by a shaft 9 in a clockwise direction. The drum 7 is provided with at least two drum wheels 57, arranged at a distance to each other. Each drum wheel 57 is provided along the circumference with a respective movable gripper 8 and a suction device 34, which are used for pulling the sheets 4 from a stack 3 positioned inside a magazine 5. In one embodiment, the sheets are pulled form an overlapping flow. When the drum 7 rotates, the lowest sheet 4 in the stack 3 is gripped and moved downward in clockwise direction. The individually pulled-off sheets 4 are guided between conveying belts 23 (shown in FIG. 2).

Each conveying belt 23 is guided by a roll bearing 22 around a rod 19 that is fixedly attached to a frame. The sheets 4 are printed sheets, for example, intended for producing magazines, brochures, or books.

The pulled-off sheets 4 are supplied individually to a folding device 6, comprising a folding sword 39, which extends at an angle and is tangential to the drum 7. A round chord 36, which is fitted around two spaced-apart rolls 37 and 38, is positioned on the folding sword 39. The round chord 36 operates jointly with a folding belt 35, which is driven in the direction of arrow 42. The pulled-off sheets 4 disposed on the folding sword 39 are taken over by the round chord 36 and the folding belt 35 from the conveying belts 23 and folded between folding rolls 44. The individual folding locations are pressed again with pressing rolls 41. The sheets 4 are released individually via a sword extension 40, for example, to a conveying device 2 of a gathering and wire-stitching machine (not shown). The folded sheets are picked up by pushers 52 and moved in the direction of arrow 43. The sheets 4 are positioned straddling on the conveying device of the gathering and wire-stitching machine, with the fold pointing upward.

Figure 3:
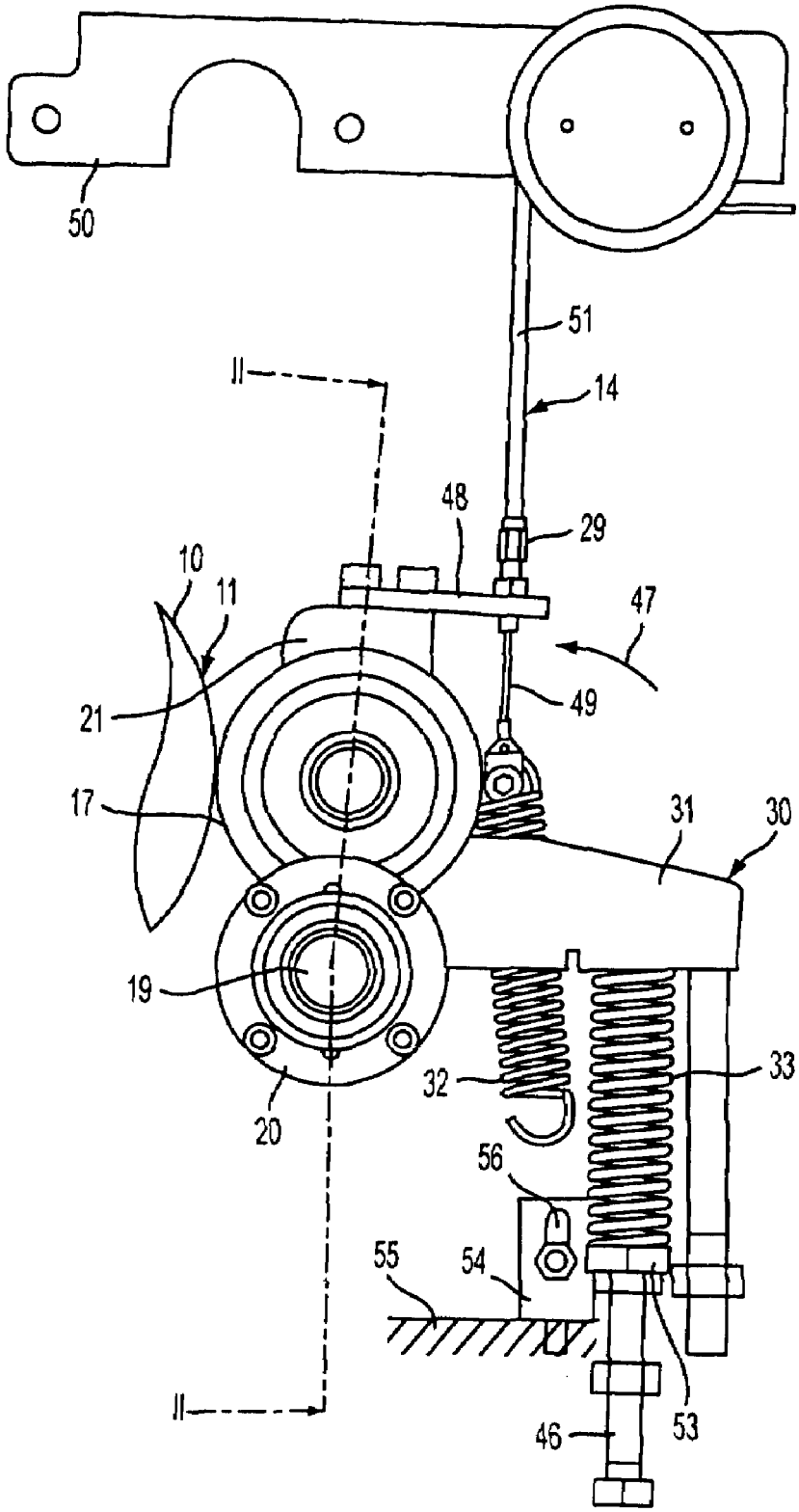
FIG. 3 A partial view of the folder feeder according to the invention, in particular illustrating the positioning of the creasing wheel.
Figure 4:
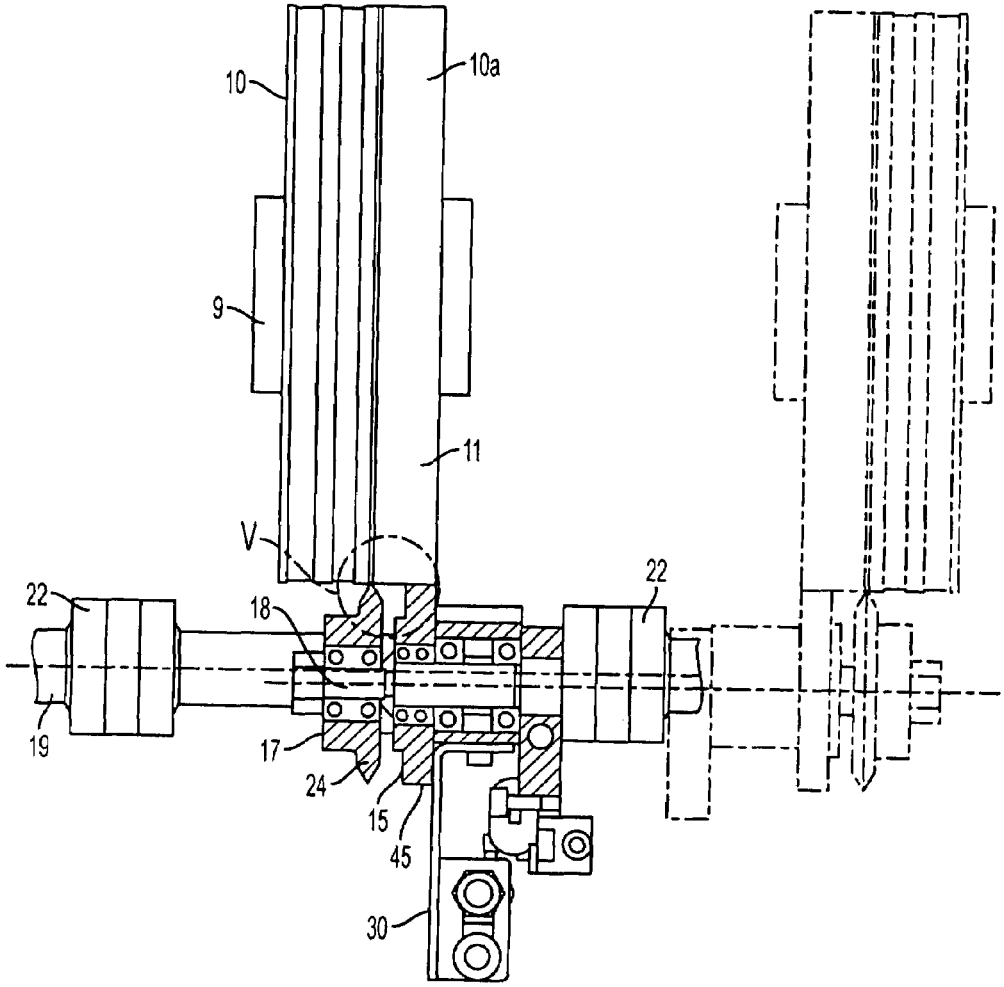
FIG. 4 A partial sectional view of a portion of the folder feeder according to an embodiment of the invention, and FIG. 5 A partial view of FIG. 4 on an enlarged scale.
Figure 5:
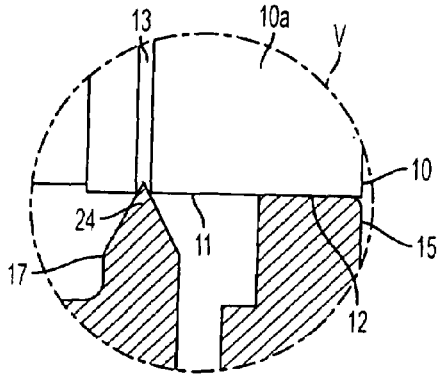

Before the sheets 4 are individually guided onto the folding sword 39, the sheets are creased in the transporting direction by a creasing apparatus that includes a first creasing wheel 17 and a creasing device 10, as shown in FIG. 4. The creasing device 10 is fixedly mounted on the drum 7. The first creasing wheel 17 is driven in a counterclockwise direction as shown in FIG. 1. The creasing device 10 includes a second creasing wheel 10*a* having a cylindrical circumferential surface 11 including a circumferential groove 13 as shown in FIG. 5. At a distance to the groove 13, the circumferential surface 11 includes a running surface 12 for a tracing wheel 15, which is positioned rotatingly on an arm 21. According to FIGS. 2 and 3, the arm 21 is connected to the rod 19, which is attached with its ends and the flanges 20 to a machine frame (not shown). The tracing wheel 15 is positioned via a roller bearing 26 on a shaft 28 which, in turn, is positioned via a bearing 27 on the extension arm 21. The tracing wheel 15 has a cylindrical circumferential surface 45, which is pressed resiliently against the running surface 12 with a tensioning device 30. FIG. 3 shows that the contact force is generated by a spring 33, which sits on a nut 53 that is screwed onto a cylindrical screw 46. The nut 53 is supported via a part 54 on a frame 55 that is only indicated herein. An elongated hole 56 makes it possible to adjust the tension of spring 33. The tensioned spring 33 acts via a holder 31 of the tensioning device 30 onto the extension arm 21. The holder 31 is fixedly connected to the extension arm 21 and extends approximately at a right angle thereto. As shown in FIG. 3, the contact force acts in the direction of arrow 47, wherein the rod 19 forms the rotational shaft. As a result of the contact force, the tracing wheel 15 is pressed with an adjustable constant force against the second creasing wheel 10*a* of the creasing device 10.

Figure 2:
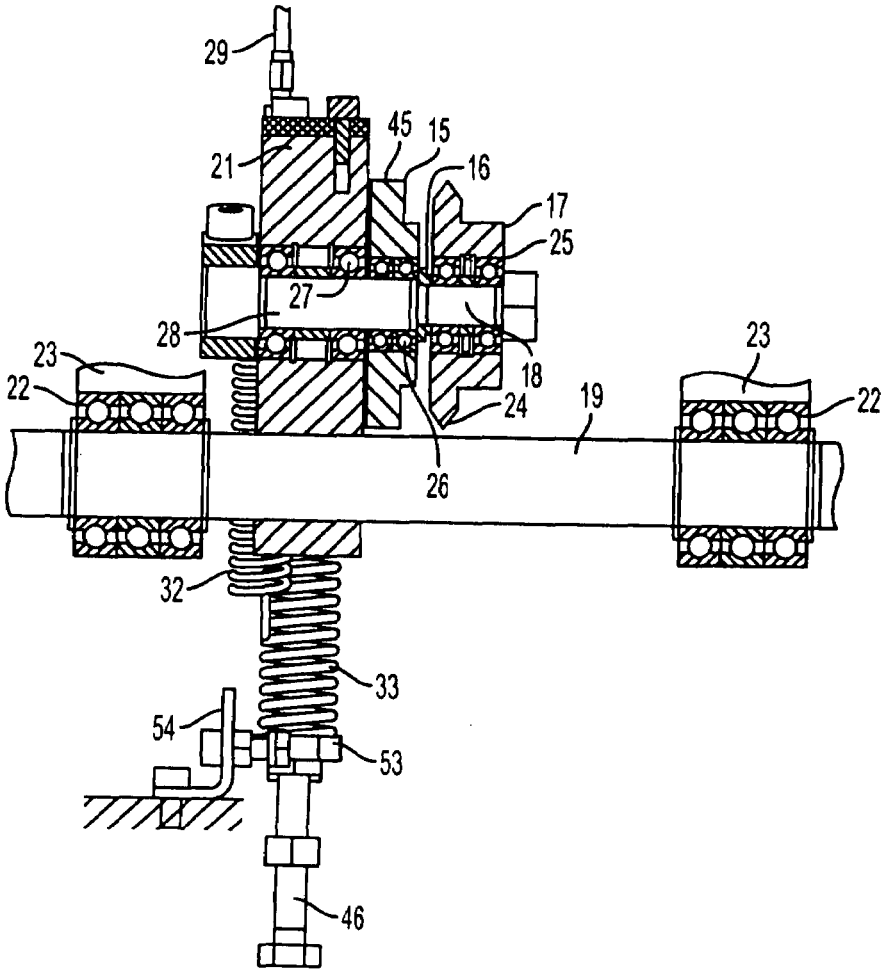
FIG. 2 A sectional view along the line II-II in FIG. 3.

According to FIG. 2, the shaft 28 is connected via an eccentric connection 16 to a shaft 18 on which the tracing wheel 15 is positioned rotating with a roller bearing 25. The first creasing wheel 17 is provided in the circumferential direction with a creasing edge 24. As shown in FIG. 5, the creasing edge 24 extends at a uniform depth into the groove 13 when the tracing wheel 15 is pressed on running surface 12. For example, the depth of the groove 13 is about 0.02 mm. In one embodiment, a ridge is used instead of the groove 13. The first creasing wheel 17 is provided with a corresponding circumferential groove in place of the creasing edge 24. The first and second creasing wheels 17, 10*a* may be embodied so that the sheets 4 that pass through are perforated. According to an alternative embodiment, a perforation device may be arranged adjacent at least the first creasing wheel 17, to perforate the sheets parallel to a folding edge.

The pulled-off sheets 4, which are conveyed substantially vertically, are creased while passing between the creasing device 10 and the first creasing wheel 17. The tracing wheel 15 in the process runs off the respectively withdrawn sheet 4, which is pressed against the circumferential surface 11 as a result of the pressure exerted by the tracing wheel 15. The first creasing wheel 17 rotates passively around the shaft 18, for which the distance to the circumferential surface 11 and/or the groove 13 is kept uniform by the tracing wheel 15. The running surface 12 is the reference surface, which extends concentric to the groove 13. As a result of the connection 16, the first creasing wheel 17 follows the re-adjustment movements of the tracing wheel 15, thereby balancing out any untrue movement or eccentricity occurring as a result of the production. The engagement of the first creasing wheel 17 in the groove 13 is thus kept constant. The formed groove and/or the perforation in the withdrawn sheet 4 is kept at a uniform depth. Because of the eccentric connection between the tracing wheel 15 and shaft 18, the distance between the shaft 18 and the circumferential surface 11 may be adjusted, thereby making it possible to precisely adjust the creasing depth.

The creased sheets 4 are transferred to the folder 6, as explained above, in which the sheets 4 are folded along the pre-formed crease by pressing between the folding rolls 44.

The contact pressure of the tracing wheel 15 against the second creasing wheel 10*a* may be adjusted, as shown in FIG. 3, with an adjustment device 14 that comprises a Bowden wire 29. The Bowden wire 29 acts with a chord 49 upon a spring 32, which is connected to the holder 31. The Bowden wire 29 is attached to a support 50, mounted fixedly on a frame, and may be operated with a manual wheel (not shown). The guide sleeve 51 for the Bowden wire 29 is connected via a holder 48 to the arm 21. A counter pressure is built up on the spring 33 for tensioning the spring 32 by the Bowden wire 29, thereby reducing the contact pressure exerted by the tracing wheel 15 onto the second creasing wheel 10*a*. The contact pressure may also be increased by reversing the steps.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A folder feeder, comprising:

a folder adapted to fold sheets;

a drum having a circumferential surface defining a groove, the drum adapted to withdraw sheets from a stack or from an overlapping flow and feeding the sheets to the folder; and a creasing apparatus operatively arranged with the drum and including:

a first creasing wheel aligned with the groove in the circumferential surface of the drum to crease the withdrawn sheets that are fed to the folder, the creasing wheel defining a creasing wheel axis, and a tracing wheel offset laterally from the groove and running on the circumferential surface of the drum to maintain a constant distance between the first creasing wheel and the circumferential surface of the drum, the tracing wheel defining a tracing wheel axis that is parallel to the creasing wheel axis.

2. The folder feeder according to claim 1, wherein the tracing wheel is pressed with a spring force against the circumferential surface of the drum.

3. The folder feeder according to claim 1, wherein the first creasing wheel is positioned to be adjusted in a radial direction relative to the drum.

4. The folder feeder according to claim 1, wherein the first creasing wheel and the tracing wheel comprise an integral unit.

5. The folder feeder according to claim 1, wherein the creasing apparatus further includes:

an eccentric connection linking the first creasing wheel and the tracing wheel.

6. The folder feeder according to claim 1, wherein the creasing apparatus further includes:

an arm, on which the first creasing wheel and the tracing wheel are positioned, the arm being arranged to swivel about an axis that is parallel to a rotational axis of the drum.

7. The folder feeder according to claim 1, wherein the creasing apparatus further includes:

an adjustment device to adjust a contact pressure of the tracing wheel against the circumferential surface of the drum.

8. The folder feeder according to claim 1, wherein the drum includes two drum wheels to withdraw individual sheets and transport each withdrawn sheet substantially vertically in a downward direction, and wherein the creasing apparatus includes a creasing device disposed between the two drum wheels.

9. The folder feeder according to claim 8, wherein the creasing device includes:

a second creasing wheel having a circumferential surface with at least one of a ridge or a groove extending over at least a portion of the circumferential surface of the second creasing wheel.

10. The folder feeder according to claim 9, wherein the first creasing wheel is disposed along the circumferential surface of the second creasing wheel and forms a complementary arrangement with the ridge or groove of the second creasing wheel.

11. The folder feeder according to claim 1, further including:

a perforation device arranged adjacent at least the first creasing wheel, to perforate the sheets parallel to a folding edge.

12. The folder feeder according to claim 9, wherein the first and second creasing wheels are adapted to perforate the withdrawn sheets.

13. The folder feeder according to claim 9, wherein the second creasing wheel constitutes a third drum wheel coaxially arranged and rotating with the two drum wheels.

* * * * *